US005362595A

United States Patent [19]

Hirayama et al.

[11] Patent Number: 5,362,595

[45] Date of Patent: Nov. 8, 1994

[54] ELECTROPHOTOGRAPHIC TONER PRODUCTION PROCESS

[75] Inventors: Nobuhiro Hirayama, Yokohama; Masaaki Shin, Fujisawa; Shoji Kawasaki, Yokohama; Akira Misawa, Kamakura; Akio Fujiwara, Yokohama; Kenji Uchiyama, Odawara, all of Japan

[73] Assignee: Mitsui Toatsu Chemicals, Incorporated, Tokyo, Japan

[21] Appl. No.: 966,570

[22] Filed: Oct. 26, 1992

Related U.S. Application Data

[60] Continuation of Ser. No. 747,700, Aug. 20, 1991, abandoned, which is a division of Ser. No. 320,239, Feb. 24, 1989, Pat. No. 5,084,368.

[30] Foreign Application Priority Data

Jul. 10, 1987 [JP] Japan ..... 62-171088

[51] Int. Cl.[5] ..... G03G 9/087

[52] U.S. Cl. ..... 430/137; 430/111

[58] Field of Search ..... 430/109, 137, 138

[56] References Cited

U.S. PATENT DOCUMENTS 4,535,049 8/1985 Honda et al. ..... 430/137
4,849,316 7/1989 Kawaski et al. .
4,963,456 10/1990 Shin et al. .

FOREIGN PATENT DOCUMENTS 49-101031 9/1974 Japan .
50-144446 11/1975 Japan .
55-6895 2/1980 Japan .
58-40183 9/1983 Japan .
60-150056 8/1985 Japan ..... G03G 9/08
62-049362 3/1987 Japan ..... G03G 9/08
62-115170 5/1987 Japan ..... G03G 9/08
161449 3/1991 Japan .

*Primary Examiner*—Roland Martin
*Attorney, Agent, or Firm*—Oblon, Spivak, McClelland, Maier & Neustadt

[57] ABSTRACT

This invention discloses electrophotographic toners and the methods for their preparation. The electrophotographic toners contain resin and coloring agents as primary components. The resin is a non-crosslinked polymer of vinyl monomers or its mixtures, and has a number average molecular weight (Mn) of 2,000–15,000, a Z average molecular weight (Mz) of not less than 400,000 and Mz/Mn of 50–600. The electrophotographic toners exert an excellent fixing ability at high duplication speed or at lower temperatures.

5 Claims, No Drawings

ELECTROPHOTOGRAPHIC TONER PRODUCTION PROCESS

This application is a continuation of application Ser. No. 07/747,700, filed on Aug. 20, 1991 now abandoned, which is a division of Ser. No. 07/320,239, filed Feb. 24, 1989 now U.S. Pat. No. 5,084,368.

FIELD OF THE INVENTION

The present invention relates to an electrophotographic toner for use in the development of an electrostatic image in electrophotography, electrostatic recording, electrostatic printing and the like.

BACKGROUND OF THE TECHNIC

Still more increasing tendency of duplication speed has recently been found in the electrophotography due to the increase of information to be treated.

Consequently, the heat quantity transferred from hot fixing rolls to toner is less at high duplication speed than at low duplication speed. A remarkable decrease in the surface temperature of fixing rolls is also caused by the heat removal to copying papers. Therefore the toner is required to be fixed at lower temperatures and also to be free from offset phenomenon at these fixing temperatures. In order to obtain a sharp image, improvement of resin has been conducted with respect to hot melt properties such as fixing ability at lower temperatures and offset resistance, as well as electrostatic characteristics of the toner.

For example, several patents have been known. Japanese Patent Publication No. 6895/1980 discloses a method for providing a toner having a good offset resistance by using the resin having a weight-average molecular weight/number average molecular weight ratio of 3.5–40 and a number average molecular weight of 2,000–30,000. Japanese Patent Laid-open No. 144,446/1975 describes a method for improving the fixing ability by adding a small amount of plasticizers such as phthalic acid diester into a toner having a good blocking and offset resistance. Japanese Patent Laid-open No. 101,031/1974 discloses a method for extending the range of fixing temperatures by using a crosslinked resin and for employing a toner which is offset resistant even at relatively high fixing temperatures. Besides patents are known as a countermeasure for providing the high electrostatic charge characteristics for the toner. For example, Japanese Patent Publication 40,183/1983 discloses a method for using aliphatic unsaturated carboxylic acids such as methacrylic acid as a component of the resin. Japanese Patent Laid-open No. 93,457/1984 discloses a method for providing charge stability together with the high electrostatic charge characteristics by adding a charge control agent composed of metal containing dyestuffs as a toner ingredient.

Furthermore, Japanese Patent Laid-open No. 16,144/1981 relevant to U.S. Pat. No. 4,499,168 describes a method for providing a magnetic toner which is excellent in the fixing ability and impact resistance by employing the resin having the maximum value of molecular weight in a specific molecular weight region.

As above mentioned, the heat quantity provided from the hot fixing rolls is less at the high duplication speed than at the low-duplication speed. A marked decrease in the surface temperature of fixing rolls is also caused by the heat removal to the copying papers. Therefore it is necessary fixing with a smaller quantity of heat. Smaller molecules having lower glass transition temperature (hereinafter abbreviated as Tg) are required for melting with low calory. Excess lowering of Tg, however, causes blocking and there is naturally a lower limit for the Tg. The smaller molecules are assumed to reduce their melt viscosity more rapidly, enhance flowability of the resin at lower temperatures, and improve the fixing ability. Too small molecules, however, lead to lowering of Tg and occurrence of blocking problems.

On the other hand, as a result of increase in the duplication speed and numbers of copying papers, the duplicated images are expected to have the same quality from the 1st to the dozens of thousandth sheet in addition to have a sharp image and perfect fixation of the toner to the paper.

Conventional methods for the improvement of offset resistance and low temperature fixation are related to the problems occurring after adhesion of the toner to the paper. These methods are important and yet not considered upon the requirement for adhering the toner in advance on each copying paper uniformly and at a constant concentration. The electrostatic charge characteristics of the toner is an important factor for the determination of toner quantity adhering on the paper and controls the image concentration. On the other hand, in the two component type developers for example, triboelectrostatic charge generates by the friction of the toner with carrier. Consequently partial destruction of the toner causes separation of resin particulates, particulate powder of coloring agents such as carbon black, or powder of its aggregates. These particulates are different from the employed toner particles in diameter and shape, ratio of the resin to coloring agents, molecular weight caused by destruction of the binder resin molecules etc. Thus these particulates exhibit different behavior on the electrostatic charge characteristics. Consequently scattering of the particulates, make a darty mark in the copy machine and increase in the background concentration of image are generated as the increase in numbers of copying papers. As a result, the duplicated image cannot be maintained in the same quality.

In addition, the particulates are absorbed on the carrier and result in the variation of triboelectrostatic charge which leads to alter the image concentration. Accordingly the consistent maintenance of a constant image concentration cannot be achieved. Aforesaid Japanese Patent Laid-open No. 16,144/1981 describes that above mentioned destruction of the toner results from the lack of hardness in the binder resin and defines to have the maximum value in a molecular weight region of $10^5-2\times10^6$. The correlation between presence of the maximum value and hardness is not clear. Furthermore the maximum value is not essential for preventing the destruction of toner even though the maximum value exists in this molecular weight region.

On the other hand, the method of Japanese Patent Laid-open No. 101,031/1974 is an effective technique for improving resin strength and yet may cause poor flowability in the melted stage by the hot rollers because crosslinked binder resin, that is, gel is contained in the toner. Consequently, irregular gloss is emerged on the duplicated image, particularly in the solid block parts of the duplicate, and remarkably damages the quality of image.

The methods of Japanese Patent Publication No. 40,183/1983 and Japanese Patent Laid-open No.

93,457/1984 are considered excellent for controlling the quantity of electrostatic charge in the initial stage of duplication. The toner, however, is not guaranteed for its strength at all and has not yet been solved the problem of its destruction caused by increase in the numbers of copying papers.

Disclosure of the Invention

The object of this invention is to provide an electrophotographic toner which is excellent in the fixing ability under high speed or at lower temperatures, capable of obtaining a sharp, clean and good image, and also outstanding in the resistance against blocking and offset.

Another object of this invention is to provide a suitable method for the preparation of the electrophotographic toner having aforesaid excellent properties. More particularly, it is to provide a method for preparing a toner resin which is specified in number average molecular weight (Mn), Z average molecular weight (Mz) and Mz/Mn, by mixing high molecular weight polymer with low molecular weight polymer.

The aforementioned first object can be achieved by providing the following electrophotographic toner. That is, the toner contains resin and a coloring agent as primary components, said resin is a non-crosslinked polymer of vinyl monomer or its mixture, and the resin has a number average molecular weight (Mn) of 2,000–15,000, a Z average molecular weight (Mz) of not less than 400,000 and a ratio of the Z average molecular weight to the number average molecular weight, e.g. Mz/Mn, of 50–600.

The resin in the aforementioned toner is a mixture obtained by mixing the high molecular weight polymer and the low molecular weight polymer in a state of solution. The high molecular weight polymer is preferably a polymer having the Z average molecular weight of not less than 400,000 prepared by a two step polymerization of the vinyl monomer. In the two-step polymerization, the monomer is subjected to a bulk polymerization to the conversion of 30–90% by weight and successively added with a solvent and a polymerization initiator to continue the reaction by a solution polymerization.

The aforesaid second object can be achieved by providing the method for preparing the toner resin having a number average molecular weight (Mn) of 2,000–15,000, a Z average molecular weight (Mz) of not less than 400,000, and Mz/Mn of 50–600 which comprises mixing 30–70 parts by weight of a solid component of high molecular weight polymer obtained by heating a vinyl monomer at 60°–150° C., conducting a bulk polymerization to a conversion of 30–90% by weight, successively adding a solvent to reduce the viscosity of reaction mixture and carrying out a solution polymerization at 60°–150° C., with 70–30 parts by weight of a solid component of low molecular weight polymer obtained by polymerizing a styrene type vinyl monomer at 190°–230° C. in a state of solution, and followed by removing the solvent from the resulting mixture.

The present inventors have assumed that the aforesaid problems are resulted from the lack of resin viscosity in the hot kneading stage conducted under melting of the coloring agent and the resin. The lack of viscosity is considered to cause poor dispersion of the coloring agent and its secondary aggregates in the resin. Thus destruction is liable to occur through the impact during the duplication in the neighborhood of interface between the coloring agent and the resin. Consequently by increasing Mz and Mz/Mn of the resin, the toner has been found to reduce the variation of its electrostatic charge during the duplication to a level of 10% or less, provide images having always constant quality during the duplication and at the same time improve the offset resistance remarkably. Besides a marked improvement in the fixing ability has also been found by controlling Mn and Mz/Mn of the resin. Furthermore the resin obtained by mixing with the low molecular weight polymer polymerized at high temperatures and performing the solvent removal, has also been found to significantly improve the fixing ability.

The noncrosslinked polymer in this invention refers to the polymer which can be dissolved in tetrahydrofuran (THF) and found no insoluble ingredients. The polymer or the mixture of polymers employed in this invention is required to have a Mn range of 2,000–15,000 and particularly preferred to have a range of 2,000–10,000 in order to provide heat melting ability for the toner resin at lower temperatures. The Mn value of less than 2,000 leads to poor dispersion of the coloring agent due to the viscosity reduction during the kneading, whereas that of exceeding 15,000 results in poor fixing ability.

Besides the Z average molecular weight is the most important factor. That is, Mz most suitably indicates the size and amount of the molecular weight in the tailing portion of higher molecular weight side and has a large effect on the properties of toner. The greater value of Mz has been found to enhance the resin strength, increase the viscosity during the hot kneading, improve the dispersibility of the coloring agent, reduce the variation of electrostatic charge during the duplication, maintain the image concentration more constantly during the duplication and reduces so-called fogging which is caused by the contamination of image substrates due to scattering troubles. In order to obtain these favorable effects, Mz is 400,000 and more, and preferably 500,000 and more in particular.

Besides it is needed to be easy to melt at the temperature and to have a high viscosity in the hot kneading stage. In order to obtain good melting ability and increased melt viscosity, the ratio Mz/Mn is in the range of 50–600 and preferably 70–600 in particular. Such resin is preferred because it has a molecular weight region broadly extending from low polymers to ultrahigh polymers which increase the value of Mz. The ratio Mz/Mn of less than 50 leads to poor hot-melting ability and deteriorates all of the duplication characteristics. On the other hand, in consideration of improving the properties in the neighborhood of 600, the ratio Mz/Mn of exceeding 600 is also supposed to have similar effect, and yet it is difficult to prepare such resin.

The resin containing aforesaid high molecular weight polymer having large Mz and low molecular weight polymer is generally prepared by the following method. The solution polymerization is carried out at lower temperatures with a reduced rate of polymerization in the presence of solvent and polymerization initiator to form the high molecular weight polymer having large Z average molecular weight. The solution polymerization is further continued at high temperatures in the presence of a large quantity of the polymerization initiator to obtain the resin. The method, however, requires a long reaction time and causes poor productivity in order to obtain sufficient amount of the high molecular weight polymer by polymerizing at lower temperatures.

An example of more preferred methods includes a two step polymerization method wherein the vinyl monomer is subjected to the bulk polymerization at a temperature of 60°–140° C. to a high conversion, followed by adding the solvent and the polymerization initiator, and conducting the solution polymerization to prepare a mixture with the low molecular weight polymer.

Suspension polymerization or emulsion polymerization is generally carried out in order to increase the molecular weight of polymers. In such methods, however, emulsifiers or dispersants used in the polymerization are contained in both phases of water, the dispersing medium, and polymer particles. Thus it is difficult to sufficiently remove the emulsifiers or the dispersants. In addition it is also hard to make the amount of these removed impurities constant. Therefore, the effect of environmental humidity is very large on such polymers when they are used as the toner resin, and the object of this invention cannot be achieved. That is, the variation of electrostatic charge is difficult to reduce during the continuous copying operation for many hours and constant quality of the duplicate is difficult to obtain.

The method for increasing the ratio Mz/Mn without containing crosslinked polymers such as gel has been extensively examined by bulk and solution polymerization. Consequently the two step polymerization has been conducted by polymerizing the vinyl monomer in bulk at a temperature of 60°–140° C. to a conversion of 30–90% by weight, successively adding the solvent and polymerization initiator and carrying out the solution polymerization. The resulting high molecular weight polymer having a Z average molecular weight of not less than 400,000 has been mixed with the low molecular weight polymer in a solution. The resin composition thus obtained has been found to be suitable for the purpose of this invention.

Examples of the vinyl monomers which may be used in the present invention include acrylate esters such as methyl acrylate, ethyl acrylate, propyl acrylate, butyl acrylate, octyl acrylate, cyclohexyl acrylate, lauryl acrylate, stearyl acrylate, benzyl 10 acrylate, furfuryl acrylate, tetrahydrofurfuryl acrylate, hydroxyethyl acrylate, hydroxybutyl acrylate, dimethylaminomethyl acrylate, dimethylaminoethyl acrylate; methacrylate esters such as methyl methacrylate, ethyl methacrylate, propyl methacrylate, butyl methacrylate, octyl methacrylate, a lauryl methacrylate, stearyl methacrylate, cyclohexyl methacrylate, benzyl methacrylate, furfuryl methacrylate, tetrahydrofurfuryl methacrylate, hydroxyethyl methacrylate, hydroxypropyl methacrylate, hydroxybutyl methacrylate, dimethylaminomethyl methacrylate, dimethylaminoethyl methacrylate; aromatic vinyl monomers such as styrene, vinyl toluene, α-methyl styrene, chlorostyrene; unsaturated dibasic acid dialkyl esters such as dibutyl maleate, dioctyl maleate, dibutyl fumarate, dioctyl fumarate; vinyl esters such as vinyl acetate, vinyl propionate; nitrogen containing vinyl monomers such as acryl nitrile, methacrylonitrile; unsaturated carboxylic acids such as acrylic acid, methacrylic acid, cinnamic acid; unsaturated dicarboxylic acids such as maleic acid, maleic anhydride, fumaric acid, itaconic acid; and unsaturated dicarboxylic acid monoesters such as monomethyl maleate, monoethyl maleate, monobutyl maleate, monoctyl maleate, monomethyl fumarate, monoethyl fumarate, monobutyl fumarate, monoctyl furmarate; styrenesulfonic acid, acrylamide, methacrylamide, N-substituted acrylamide, N-substituted methacrylamide, acrylamidepropanesulfonic acid and the like. These vinyl monomers may be used alone or in combination of two or more. Among these monomers, particularly preferred are acrylate esters, methacrylate esters, styrene, dialkyl fumarates, acrylonitrile, methacrylic acid, cinnamic acid, fumaric acid monoesters, acrylamide and methacrylamide.

Besides in the method of this invention, styrene type vinyl monomers such as styrene, α-methylstyrene, o-, m- and p-methylstyrene, vinyltoluene and chlorostyrene may be used as a primary component and optionally copolymerized with above mentioned vinyl monomers. Among these styrene type vinyl monomers, styrene alone and combinations of styrene, methacrylic acid and/or methyl methacrylate are preferred in particular.

Upon preparation of the high molecular weight polymer from aforesaid vinyl monomers, the two step polymerization may be conducted by polymerizing in bulk at a temperature of 60°–150° C. in the absence of polymerization initiator, successively adding the solvent and polymerization initiator, and completing the reaction by the solution polymerization. Mz of the resulting polymer, however, depends largely upon the conversion in the bulk polymerization. According 10 to the examination of the present inventors, a trace amount of the polymerization initiator may optionally be added by portions at 60°–80° C. This procedure, however, takes many hours and causes poor productivity. More preferable results can be obtained by conducting heat polymerization at a temperature of 80°–150° C. in the absence of polymerization initiator.

The conversion in the bulk polymerization has given good results in the range of 30–90% by weight, more preferably 35–85% by weight. Sufficiently large Mz cannot be obtained from the conversion of less than 30% by weight. When the conversion exceeds 90% by weight, the increase in Mz is saturated and the polymer becomes hard to handle in the actual production due to high viscosity.

The termination of bulk polymerization may also be achieved by cooling the reaction mixture or by the addition of cold solvent. The solvent which may be used in the successive solution polymerization includes, for example, aromatic hydrocarbons such as benzene, toluene, ethylbenzene, o-xylene, m-xylene, p-xylene and cumene. These hydrocarbons may be used alone or in combination. Molecular weight control may also be performed by selecting other solvents.

The solution polymerization is normally carried out at a temperature of 80°–150° C., and may also be conducted outside of this temperature range in order to adjust the molecular weight. The solution polymerization is performed by adding the uniform mixture of the polymerization initiator and solvent continuously or by portions over 1–20 hours. The addition by portions enhances the variation of polymerization initiator concentration and leads to a poor reproducibility of the molecular weight. Therefore continuous addition is preferably used in the reaction. Any compound which may be usually used as the initiator of radical polymerization may be employed for the polymerization initiator of this invention.

Examples of the polymerization initiator include, azo compounds such as 2,2'-azobisisobutyronitrile, 2,2'-azobis(4-methoxy-2,4-dimethylvaleronitrile) , 2,2'-azobis (2,4-dimethylvaleronitrile) , 2,2'-azobis( 2-methylbutyronitrile), dimethyl-2,2'-azobisisobutyrate, 1,1'-azobis (1-cyclohexanecarbonitrile), 2-(carbamoyiazo)isobutyronitrile, 2,2'-azobis(2,4,4-trimethyipentane), 2-phenylazo-2,4-dimethyl-4-methoxyvaleronitrile, 2,2'-azobis (2-methylpropane); ketone peroxides such as methyl ethyl ketone peroxide, acetylacetone peroxide, cyclohexanone peroxide; peroxyketals such as 1,1-bis(t-butylperoxy) -3,3,5-trimethylcyclohexane, 1,1-bis(butylperoxy)cyclohexane, 2,2-bis(t-butylperoxy) butane; hydroperoxides such as t-butyl hydroperoxide, cumene hydroperoxide, 1,1,3,3-tetramethylbutyl hydroperoxide; dialkyl peroxides such as di-t-butyl peroxide, t-butyl cumyl peroxide, dicumyl peroxide, 2,5-dimethyl-2,5-di(t-butylperoxy)hexane, $\alpha,\alpha'$-bis(t-butylperoxyisopropylbenzene); diacyl peroxides such as isobutyryl peroxide, octanoyl peroxide, decanoyl peroxide, lauroyl peroxide, 3,5,5-trimethylhexanoyl peroxide, benzoyl peroxide, m-toluyl - peroxide; peroxydicarbonates such as diisopropyl peroxydicarbonate, di-2-ethylhexyl peroxydicarbonate, di-n-propyl peroxydicarbonate, di-2-ethoxyethyl peroxydicarbonate, dimethoxyisopropyl peroxydicarbonate, di (3-methyl-3-methoxybutyl) peroxydicarbonate; sulfonyl peroxides such as acetylcyclohexylsulfonyl peroxide; peroxyesters such as t-butyl peroxyacetate, t-butyl peroxyisobutyrate, t-butyl peroxyneodecanoate, cumyl peroxyneododecanoate, t-butyl peroxy-2-ethylhexanoate, t-butyl peroxylaurate, t-butyl peroxybenzoate, t-butyl peroxyisopropylcarbonate, di-t-butyl diperoxyisophthalate; and the like.

The type and quantity of such polymerization initiator may be suitably selected according to the reaction temperature and conversion of the bulk polymerization. The initiator is normally used in an amount of 0.01–10 parts by weight per 100 parts by weight of the monomer employed.

The aforesaid method can prepare the high molecular weight polymer which is soluble in solvents, free from the gel and has a high Mz. In addition, ultra-high molecular weight polymer can be obtained by the use of a divinyl compound. That is, at the termination of bulk polymerization or in the solution polymerization stage, the divinyl compound is added in an amount of 0.01–1 part by weight per 100 parts by weight of the total amount of monomer used. The reaction can increase Mz of the intact solvent soluble polymer without accompanying three-dimensional crosslinking reaction by the divinyl compound. The divinyl compound which may be employed in this invention is capable of copolymerizing with the above-mentioned ethylenically unsaturated monomer. Examples of the divinyl compound include divinylbenzene, (poly)ethylene glycol diacrylate and (poly) ethylene glycol dimethacrylate. The greater amount in use leads to higher effect on the Mz increase, and yet it is undesirable to use more than 1 part by weight because gel like insoluble matter is found.

An alternative method for further increasing Mz is to use methacrylic acid in an amount of 1–15 parts by weight in 100 parts by weight of the ethylenically unsaturated monomer employed. Methacrylic acid is required to undergo the bulk polymerization in the absence of the catalyst. When methacrylic acid is added after completion of the bulk polymerization without methacrylic acid, the increase in Mz cannot be found in the successive solution polymerization. Unsaturated monomers other than methacrylic acid, for example, acrylic acid, maleic acid, monoalkyl maleate, fumaric acid and monoalkyl fumarate lead to insolubilization of the resulting polymer or exert no effect, and hence methacrylic acid is required. Methacrylic acid is used in an amount of 1–15 parts by weight. The effect on Mz increase is small in an amount less than 1 part by weight while an amount exceeding 15 parts by weight is unfavorable because of separation of the solvent insoluble matter.

Any high molecular weight polymer thus obtained has a Mz of more than 400,000 and its melt viscosity is high enough to hot kneading in the toner preparation stage. Easiness of hot melting, however, is also required in order to achieve low energy fixation at the same time. The present inventors have found more preferable method for solving these problems. In this method, the high molecular weight polymer obtained above and having a large Mz is mixed in a state of solution with the low molecular weight polymer having Mn of 1,000–5,000 so that the resulting mixture has Mn of 2,000–10,000 and Mz/Mn of 50–600.

The solution polymerization method capable of remarkably reducing the content of impurity is preferably used for preparing the low molecular weight polymer. The molecular weight may be suitably controlled by solvent/monomer ratio, sort of the solvent, use of a chain transfer agent, quantity and sort of the radical polymerization initiator, reaction temperature etc. Any of above illustrated monomer may be used for the solution polymerization.

In order to obtain heat-melting ability of the toner resin composition at lower temperatures, the low molecular weight polymer is favorably prepared by polymerizing the vinyl monomer in solution at a temperature of 190°–230° C. The resulting polymer has preferably a glass transition temperature of 40°–75° C. and a number average molecular weight of 1,000–5,000, particularly 1,500–2,800. The polymerization temperature of less than 190° C. is unpreferable because the low molecular weight polymer cannot be obtained and the fixing ability of the toner becomes poor. The polymerization temperature of exceeding 230° C. is also undesirable because by-product oligomer, apparently the thermal reaction product of the monomer, is generated in a relatively large amount and the blocking resistance of the toner reduces. Even at a polymerization temperature of less than 190° C., low molecular weight polymer can be obtained by using a large amount of the polymerization initiator, solvent or chain transfer agent. On the other hand, a large quantity of residue of polymerization initiator is difficult to eliminate in the solvent removal and liable to cause variation of the triboelectrostatic charge. The solvent also causes a marked reduction of productivity by an abundant use. A large amount use of the chain transfer agent is undesirable because of odor or corrosion problems. Therefore the low molecular weight polymer obtained by using a small amount of the polymerization initiator and a higher reaction temperature is preferable for preparing the electrostatically stable toner resin composition.

The mixing ratio of the high molecular weight polymer to the low molecular weight polymer which may be used in this invention is 30–70 parts by weight of the former as solid and 70–30 parts by weight of the latter as solid. The high molecular weight polymer in a ratio of less than 30 parts by weight fails to provide sufficiently large Mz, causes unsatisfactory dispersion of the coloring agent, leads to a large variation in the electrostatic charge, and at the same time results in an insufficient offset resistance. On the contrary, the high molecular weight polymer in a ratio of larger than 70 parts by weight causes a marked reduction of hot-melting and fixing properties. Besides the high molecular weight polymer and the low molecular weight polymer may be mixed with, for example, a stirrer in the form of solutions respectively dissolved in the same or the mutually compatible solvent. The resulting mixture is heated to a high temperature and flashed in a vacuum system, thereby the solvent, unreacted monomer, residue of polymerization initiator etc. are rapidly evaporated, foamed and removed. At the same time the polymers are further mixed to give a homogeneous mixture.

The toner which may be used in this invention is mainly a powdery dry toner. Its principal component, that is, the aforesaid polymer mixture is required to be solid at the room temperature and also to be free from caking after standing for many hours. According to such point of view, the glass transition point of the above-mentioned polymer mixture is preferably not less than 40° C. and more preferably not less than 50° C. In addition, according to the viewpoint of the lower temperature fixing ability, the polymer mixture is preferred to soften at lower temperatures as possible. Thus the glass transition temperature of the polymer mixture is preferably not more than 90° C., and more preferably not more than 80° C.

In the practice of this invention, the below described ingredients may optionally be added to the resin so long as they are harmless to the effect of this invention. The resin which may be used as a part of this invention includes, for example, polyvinyl chloride, polyvinyl acetate, polyolefin, polyester, polyvinylbutyral, polyurethane, polyamide, rosin, modified rosin, terpene resin, phenol resin, aliphatic hydrocarbon resin, aromatic petroleum resin, paraffin wax and polyolefin wax.

Examples of the coloring agent which may be used in this invention include black pigments such as carbon black, acetylene black, lamp black, magnetite, and known organic and inorganic pigments such as chrome yellow, iron oxide yellow, Hansa yellow G, quinoline yellow lake, permanent yellow NCG, molybdene orange, vulcan orange, indanthrene, brilliant orange GK, iron oxide red, brilliant carmine 6B, flizarin lake, methyl violet lake, fast violet B, cobalt blue, alkali blue lake, phthalocyanine blue, fast sky blue, pigment green B, malachite green lake, titanium dioxide and zinc white. These ingredients are added normally in an amount of 5–250 parts by weight per 100 parts by weight of the resin.

The toner composition of this invention may be selectively added with known charge control agent, such as nigrosine and metal containing azo dyestuff, pigment dispersant and offset inhibitors. The toner may be prepared by known methods. That is, the resin composition which has previously been added with aforesaid various ingredients is premixed in a powdery state and kneaded in a hot-melted stage by use of processing machines such as hot rolls, bumbury mixer, extruder etc.. After cooling the resulting mass, it is finely ground with a pulverizing mill and subjected to classification with an air classifier. The particles having diameters ranging normally 8–20 μm are collected to prepare the toner.

EXAMPLE

The present invention will further be illustrated in detail with respect to the following examples. Unless otherwise explained practically, the unit is part by weight or percent by weight.

Z average molecular weight (Mz), weight average molecular weight (Mw) and number average molecular weight (Mn) were determined by the following conditions in accordance with GPC.

GPC equipment: JASCO TWINCLE HPLC
Detector: SHODEX R1-SE-31
Column: SHODEX GPCA-80MX2+KF-802XI
Solvent: Tetrahydrofuran (THF)
Flow rate: 1.2 ml/min
Sample: 0.25% THF solution Furthermore duplication characteristics were measured under the following conditions by Electrophotographic Copying Machine EP870 (a product from Minolta Camera Co.) equipped with Teflon hot-rolls.

Fixing ability:

A plastic eraser "MONO" (a product from Tombo Pencil Co.) was gone back and forth 20 times with a constant force between a solid black part and a non-tonered white part on a duplicated sheet. Toner removal from the black part and soil of the white part were observed and divided into the following four classes.

◎ . . . No toner removal at all.
○ . . . Good.
Δ . . . Toner was somewhat removed.
X . . . Poor. Toner was removed and caused much soil.

Contamination of the white background:

The white part of the 100th sheet was compared with that of the 10,000th sheet in a continuous copying operation. The degree of contamination on the white background due to the scattering of toner was divided into the following three classes.

○ . . . Good.
Δ . . . Contamination was observed with a magnifying glass having a magnification of 30 times.
X . . . Contamination was observed with the naked eye.

Offset resistance:

The offset refers to a phenomenon that a part of the toner is attached on the surface of a fixing roll and then transferred again onto the fresh surface of a paper after one rotation of the roll to cause the contamination of the paper.

○ . . . No contamination was found over 10,000 sheets of continuous copying operation.
X . . . Contamination was found in the same conditions.

Variation of electrostatic charge:

In the continuous copying operation, triboelectrostatic charges of the 100th and 10,000th duplicates were expressed by the following ratio (absolute value).

$$\frac{\left(\begin{array}{c}\text{Amount of charge}\\ \text{after 10,000th}\\ \text{duplicate}\end{array}\right) - \left(\begin{array}{c}\text{amount of charge}\\ \text{after 100th}\\ \text{duplicate}\end{array}\right)}{\text{(Amount of charge after 100th duplicate)}} \times 100(\%)$$

When the ratio was not more than 10(%), the variation was considered good.

Dispersibility of the coloring agent:

A slide glass was put on a hot plate previously heated at 250°–300° C. and a small amount of the toner was placed on the slide glass. A cover glass was put on the toner sample simultaneously with the fusion of the toner and pressed with a given pressure for 60 seconds. The sample was taken out of the hot plate and allowed to cool. The dispersibility of coloring agent was observed with an optical transmission microscope having a magnification of 400°–1,000 times.

The results of the observation was divided into the following two classes.

○ . . . No undispersed or aggregated particles of the coloring agent were found in any field of vision.

X . . . Many undispersed or aggregated particles of the coloring agent were found, Reproducibility of the completely solid black part:

Irregular glass of the solid black part was observed on the 100th duplicate from the start of copying operation, The results were divided into the following three classes.

○ . . . Irregular gloss was slight.

Δ . . . Irregular gloss was found in some degree.

X . . . Irregular gloss was remarkable.

Blocking resistance:

Blocking resistance was evaluated by observing the aggregation after allowing to stand the toner for 8 hours at the temperature of 55° C. under 80% relative humidity. Results were illustrated by the following four classes.

◎ . . . No aggregation was found at all.

○ . . . Aggregation was found partially but easily unfastened.

Δ . . . Firm coagulate was found in part.

X . . . Firm coagulate was found entirely.

PREPARATION EXAMPLE 1

A flask was replaced with nitrogen and charged with 60 parts of styrene and 40 parts of butyl methacrylate as monomers. The mixture was heated in an oil bath and polymerized in bulk for 3 hours by maintaining the reaction temperature at 130° C. A conversion of 35% was obtained by the bulk polymerization in the absence of polymerization initiator. In the next step, 120 parts of xylene were added and the resulting solution was continuously added over 10 hours with a solution obtained by dissolving 1 part of azobisisobutyronitrile (AIBN) in 80 parts of xylene while maintaining the reaction temperature at 100° C. The polymerization was completed after continuing the reaction for further 2 hours. The resulting polymer was named H-1 and the results are illustrated in Table-1.

PREPARATION EXAMPLE 2

Polymers were obtained by carrying out the same procedures as in Preparation Example 1 except the reaction time of bulk polymerization was extended so as to obtain conversion of 50%, 70% and 85%. The resulting polymers were called H-2, H-3 and H-4 respectively and the results are illustrated in Table-1.

COMPARATIVE PREPARATION EXAMPLE 1

Polymer was obtained by conducting the same procedures as in Preparation Example 1 except the reaction time of bulk polymerization was reduced to obtain conversion of 20%, and a solution obtained by dissolving 1 part of AIBN and 1 part of divinyibenzene in 80 parts of xylene was added in the second step. The resulting polymer was named C-1 and the results are illustrated in Table-1.

COMPARATIVE PREPARATION EXAMPLE 2

In Preparation Example 1, 0.2 part of AIBN was added to the monomers and the bulk polymerization was conducted for 2 hours while maintaining the reaction temperature at 100° C. The resulting conversion was 44%. In the next-step, the same procedures as in Preparation Example 1 was carried out to obtain the polymer C-2. The results are illustrated in Table-1.

PREPARATION EXAMPLE 3

The polymer H-5 was obtained by conducting the same procedures as in Preparation Example 1 except 0.6 part of divinylbenzene was added after adding 120 parts of xylene in the second step. The results are illustrated in Table-1.

PREPARATION EXAMPLE 4

The polymer H-6 was obtained by conducting the same procedures as in Preparation Example 1 except the solution consisting of 1 part of AIBN and 80 parts of xylene was added with 0.6 part of divinyibenzene. The results are illustrated in Table-1.

COMPARATIVE PREPARATION EXAMPLE 3

The polymer C-3 was obtained by conducting the same procedures as in Preparation Example 4 except 1.5 parts of divinylbenzene were added. The results are illustrated in Table-1.

PREPARATION EXAMPLE 5

The polymer H-7 was obtained by conducting the same procedures as in Preparation Example 1 except 60 parts of styrene, 30 parts of butyl acrylate and 10 parts of methacrylic acid were used as the monomers. The results are illustrated in Table-1.

COMPARATIVE PREPARATION EXAMPLE 4

The polymer C-4 was obtained by conducting the same procedures as in Preparation Example 5 except 50 parts of styrene and 20 parts of methacrylic acid were used. The results are illustrated in Table-1.

COMPARATIVE PREPARATION EXAMPLE 5

The polymer C-5 was obtained by conducting the same procedure as in Preparation Example 5 except acrylic acid was used in place of methacrylic acid. The results are illustrated in Table-1.

PREPARATION EXAMPLE 6

The polymer H-8 was obtained by conducting the same procedure as in Preparation Example 1 except 70 parts of styrene, 28 parts of butyl acrylate and 2 parts of methacrylic acid were used as the monomers. The results are illustrated in Table-1.

PREPARATION EXAMPLE 7

Bulk polymerization was carried out at 130° C. for 4 hours by using 68 parts of styrene, 27 parts of butyl acrylate and 5 parts of methacrylic acid as monomers. Polymerization ratio obtained was 41% in the bulk polymerization. In the next step, 60 parts of xylene were added. The resulting solution was added with 0.3 part of tetraethyleneglycol diacrylate and then continuously added over 3 hours with a solution obtained by dissolving 5 parts of AIBN in 200 parts of xylene while maintaining the reaction temperature at 120° C. The polymerization was completed after containing the reaction for further 3 hours to obtain polymer H-9. The results are illustrated in Table-1.

COMPARATIVE PREPARATION EXAMPLE 6

The bulk polymerization was conducted at 120° C. for 2 hours by using 60 parts of styrene and 40 parts of butyl methacrylate as monomers. Conversion obtained in the bulk polymerization was 18%. In the next step, 75 parts of xylene were added. The resulting solution was added with 1.5 parts of AIBN over 8 hours by 5 portions at every 2 hours while maintaining the reaction temperature at 90° C. The polymer C-6 was obtained after completing the polymerization. The results are illustrated in Table-1.

PREPARATION EXAMPLE 8

(Example for the preparation of low molecular weight polymer)

A flask was charged with 100 parts of xylene or a solvent mixture of xylene and cumene and heated to 120°-155° C. The mixture was continuously added dropwise over 5 hours with a solution consisting of 90 parts of styrene, 10 parts of butyl acrylate and 1-5 parts of AIBN.

The polymers L-1 - L-3 having different Mn were obtained after continuing the polymerization for further 2 hours.

EXAMPLE 1

(Preparation of the toner resin)

The above-mentioned H-1~H-9, C-118 C-6 and L-1~L-3 were mixed as such or after dissolving in solvents. The mixture was heated, subjected to solvent removal under vacuum and cooled. The resulting mass was pulverized so as to obtain a size of 3 mm and less. The resin D-1~D-29 were thus obtained.

(Preparation of the toner)

In a Henshel mixer, 100 parts of the resin, parts of carbon black (MA-100: a product from Mitsubishi Chemical Co.) as a coloring agent, 3 parts of polypropylene wax and 0.5-2 parts of Spiron Black TRH as a charge control agent were mixed. The mixture was hot-kneaded with a twin screw extruder at a temperature of 140° C. (inlet)-150° C. (outlet), cooled and crushed. The resulting mass was finely ground with a jet mill and subjected to air classification to obtain the toner having a particle size of 8-20 μm (11.5 μm in average). The resulting toner was mixed with 0.15 part of colloidal silica in a Henshel mixer and tested.

The amount of charge control agent was controlled to obtain −15 μC/g of blow off electrostatic charge after mixing 95 parts of the carrier for EP870 with 5 parts of the toner in a V-blender for 30 minutes.

The test results of above-described toner are illustrated in Table-2. These results clearly illustrate that the toner of this invention exerts very excellent duplication characteristics.

Equations for calculating molecular weights are illustrated below. The molecular weights described in this invention are respectively defined as follows, provided that Ni molecules having a molecular weight of Mi are present in an unit volume.

(1) Number average molecular weight $Mn = \frac{\Sigma MiNi}{\Sigma Ni}$ (2) Weight average molecular weight $Mw = \frac{\Sigma Mi^2Ni}{\Sigma MiNi}$ (3) Z average molecualr weight $Mz = \frac{\Sigma Mi^3Ni}{\Sigma Mi^2Ni}$

TABLE 1

| | | Monomer | | | | | Bulk polymerization | |
|---|---|---|---|---|---|---|---|---|
| Example | Polymer | Styrene | Butyl meth-acrylate | Butyl acrylate | Meth-acrylic acid | Acrylic acid | Initi-ator | Conver-sion |
| P.Ex-1 (1) | H-1 | 60 | 40 | | | | 0 | 35 |
| P.Ex-2 | H-2 | 60 | 40 | | | | 0 | 50 |
| | H-3 | 60 | 40 | | | | 0 | 70 |
| | H-4 | 60 | 40 | | | | 0 | 85 |
| C.P.Ex-1 (2) | C-1 | 60 | 40 | | | | 0 | 20 |
| C.P.Ex-2 | C-2 | 60 | 40 | | | | 0.2 | 44 |
| P.Ex-3 | H-5 | 60 | 40 | | | | 0 | 35 |
| P.Ex-4 | H-6 | 60 | 40 | | | | 0 | 35 |
| C.P.Ex-3 | C-3 | 60 | 40 | | | | 0 | 35 |
| P.Ex-5 | H-7 | 60 | | 30 | 10 | | 0 | 33 |
| C.P.Ex-4 | C-4 | 50 | | 30 | 20 | | 0 | 31 |
| C.P.Ex-5 | C-5 | 60 | | 30 | | 10 | 0 | 35 |
| P.Ex-6 | H-8 | 70 | | 28 | 2 | | 0 | 34 |
| P.Ex-7 | H-9 | 68 | | 27 | 5 | | 0 | 41 |
| C.P.Ex-6 | C-6 | 60 | 40 | | | | 0 | 18 |
| P.Ex-8 | L-1 | 90 | | 10 | | | — | — |
| | L-2 | 90 | | 10 | | | — | — |
| | L-3 | 90 | | 10 | | | — | — |

| | | Divinyl compound | | Molecular weight | | | | | |
|---|---|---|---|---|---|---|---|---|---|
| Example | Polymer | Name | Amount | Mz × $10^4$ | Mw × $10^4$ | Mn × $10^4$ | Mz/Mn | Mw/Mn | Insoluble matter |
| P.Ex-1 (1) | H-1 | | | 45.5 | 19.0 | 2.4 | 19.0 | 7.9 | No. |
| P.Ex-2 | H-2 | | | 68.6 | 41.4 | 3.3 | 20.8 | 12.5 | |
| | H-3 | | | 75.4 | 44.0 | 3.1 | 24.3 | 14.2 | |
| | H-4 | | | 83.4 | 50.9 | 14.4 | 5.8 | 3.5 | |
| C.P.Ex-1 (2) | C-1 | Divinyl-benzene C.A. (3) | 1 | 38.3 | 15.7 | 1.2 | 31.9 | 13.1 | |
| C.P.Ex-2 | C-2 | | | 32.2 | 10.2 | 1.0 | 3.2 | 10.2 | |
| P.Ex-3 | H-5 | Divinyl- | 0.6 | 68.5 | 29.2 | 2.5 | 27.3 | 11.7 | |

TABLE 1-continued

| | | | | | | | | | |
|---|---|---|---|---|---|---|---|---|---|
| | | benzene | | | | | | | |
| P.Ex-4 | H-6 | Divinyl-benzene C.A. | 0.6 | 94.5 | 56.4 | 2.1 | 45.0 | 26.9 | |
| C.P.Ex-3 | C-3 | Divinyl-benzene C.A. | 1.5 | (4) — | — | — | — | — | Present |
| P.Ex-5 | H-7 | | | 84.8 | 38.0 | 1.5 | 56.5 | 25.3 | No. |
| C.P.Ex-4 | C-4 | | | (4)— | — | — | — | — | Present |
| C.P.Ex-5 | C-5 | | | (4)— | — | — | — | — | Present |
| P.Ex-6 | H-8 | | | 69.5 | 41.4 | 3.3 | 21.1 | 12.5 | |
| P.Ex-7 | H-9 | Tetraethylene glycol diacrylate | 0.3 | 186.9 | 48.1 | 1.3 | 143.8 | 37.0 | |
| C.P.Ex-6 | C-6 | | | 26.6 | 12.5 | 3.0 | 8.9 | 4.2 | |
| P.Ex-8 | L-1 | | — | 0.78 | 0.46 | 0.24 | 3.3 | 1.9 | No. |
| | L-2 | | — | 2.21 | 1.2 | 0.41 | 5.4 | 2.9 | No. |
| | L-3 | | — | 19.9 | 9.8 | 1.5 | 13.3 | 6.5 | No. |

Note:
(1) P.Ex . . . Preparation Example.
(2) C.P.Ex . . . Comparative Preparation Example
(3) C.A. . . . Continuous Addition
(4) . . . unmeasured due to THF insoluble

TABLE 2

| | | | | | | | | | | | Duplication characteristics | | | | | |
|---|---|---|---|---|---|---|---|---|---|---|---|---|---|---|---|---|
| | | High molecular weight polymer | | Low molecular weight polymer | | Resine molecular weight | | | | | Fixing ability | Contamination | Off-set | Charge variation (%) | Color dispersion | Reproducibility |
| Resin | | Name | Amount | Name | Amount | Mz × $10^4$ | Mw × $10^4$ | Mn × $10^4$ | Mz/Mn | Mw/Mn | | | | | | |
| Ex (1) | D-1 | H-5 | 90 | L-1 | 10 | 68.3 | 26.5 | 1.3 | 52.5 | 20.4 | ○~Δ | ○ | ○ | 5.7 | ○ | ○~Δ |
| Ex (1) | D-2 | H-5 | 80 | L-1 | 20 | 68.3 | 23.4 | 0.92 | 74.2 | 25.4 | ○ | ○ | ○ | 5.2 | ○ | ○ |
| Ex (1) | D-3 | H-5 | 70 | L-1 | 30 | 67.8 | 20.5 | 0.61 | 111.1 | 33.6 | ○ | ○ | ○ | 5.5 | ○ | ○ |
| Ex (1) | D-4 | H-5 | 60 | L-1 | 40 | 66.1 | 17.2 | 0.49 | 134.9 | 35.1 | ◎ | ○ | ○ | 5.2 | ○ | ○ |
| Ex (1) | D-5 | H-5 | 50 | L-1 | 50 | 65.6 | 14.7 | 0.41 | 160.0 | 35.9 | ◎ | ○ | ○ | 5.5 | ○ | ○ |
| Ex (1) | D-6 | H-5 | 40 | L-1 | 60 | 63.1 | 11.8 | 0.36 | 175.3 | 32.8 | ◎ | ○ | ○ | 4.8 | ○ | ○ |
| Ex (1) | D-7 | H-5 | 30 | L-1 | 70 | 52.6 | 8.3 | 0.32 | 164.4 | 25.9 | ◎ | ○ | ○ | 7.0 | ○ | ○ |
| C.Ex (2) | D-8 | H-5 | 20 | L-1 | 80 | 39.3 | 4.9 | 0.29 | 135.5 | 16.9 | ○ | Δ | ○ | 12.1 | Δ | ○ |
| C.Ex (2) | D-9 | H-5 | 100 | — | — | 68.5 | 29.2 | 2.5 | 27.3 | 11.7 | X | X | X | 15.2 | X | Δ |
| Ex | D-10 | H-9 | 100 | — | — | 186.9 | 48.1 | 1.3 | 143.8 | 37.0 | ○ | ○ | ○ | 3.2 | ○ | ○~Δ |
| " | D-11 | H-9 | 40 | L-1 | 60 | 176.3 | 19.5 | 0.30 | 587.7 | 65.0 | ◎ | ○ | ○ | 2.3 | ○ | ○ |
| " | D-12 | H-1 | 50 | L-2 | 50 | 45.2 | 9.8 | 0.69 | 65.5 | 14.2 | ○ | ○ | ○ | 9.5 | ○ | ○ |
| " | D-13 | H-2 | 50 | L-2 | 50 | 66.2 | 20.5 | 0.73 | 90.7 | 28.1 | ◎ | ○ | ○ | 5.3 | ○ | ○ |
| " | D-14 | H-3 | 50 | L-2 | 50 | 73.4 | 21.5 | 0.70 | 104.5 | 30.7 | ◎ | ○ | ○ | 4.2 | ○ | ○ |
| " | D-15 | H-4 | 50 | L-2 | 50 | 81.8 | 26.9 | 0.81 | 101.0 | 33.2 | ◎ | ○ | ○ | 4.1 | ○ | ○ |
| C.Ex | D-27 | H-4 | 80 | L-2 | 20 | 82.3 | 42.3 | 1.8 | 45.7 | 23.5 | X | Δ~X | Δ | 11.5 | Δ | Δ |
| Ex | D-28 | H-4 | 70 | L-2 | 30 | 82.2 | 37.1 | 1.3 | 63.2 | 28.5 | ○~Δ | ○ | ○ | 6.0 | ○ | ○~Δ |
| C.Ex | D-16 | C-1 | 50 | L-2 | 50 | 36.5 | 8.3 | 0.63 | 57.9 | 13.2 | ○~Δ | Δ | ○ | 11.5 | Δ | ○ |
| " | D-17 | C-2 | 50 | L-2 | 50 | 28.6 | 5.6 | 0.59 | 48.5 | 9.5 | X | X | Δ | 24.3 | X | ○ |
| " | D-18 | H-2 | 50 | L-3 | 50 | 68.2 | 26.3 | 2.2 | 31.0 | 12.0 | X | ○ | X | 17.0 | X | Δ |
| " | D-19 | C-3 | 50 | L-2 | 50 | (3)— | — | — | — | — | ○ | Δ | ○ | 14.3 | Δ | X |
| " | D-20 | C-5 | 50 | L-2 | 50 | (3)— | — | — | — | — | ○ | Δ | ○ | 20.6 | Δ | X |
| Ex | D-21 | H-6 | 50 | L-2 | 50 | 94.2 | 29.5 | 0.66 | 142.7 | 44.7 | ◎ | ○ | ○ | 4.3 | ○ | ○ |
| " | D-22 | H-7 | 50 | L-2 | 50 | 84.6 | 19.9 | 0.63 | 132.3 | 31.6 | ◎ | ○ | ○ | 6.1 | ○ | ○ |
| " | D-23 | H-8 | 50 | L-2 | 50 | 68.9 | 22.1 | 0.74 | 93.1 | 29.9 | ◎ | ○ | ○ | 7.1 | ○ | ○ |
| C.Ex | D-24 | C-4 | 50 | L-2 | 50 | (3)— | — | — | — | — | ◎ | ○ | ○ | 11.6 | Δ | Δ~X |
| " | D-25 | C-6 | 50 | L-2 | 50 | 23.2 | 6.7 | 0.73 | 31.8 | 9.2 | X | X | X | 16.2 | X | ○ |
| " | D-26 | — | — | L-3 | 50 | 19.9 | 9.8 | 1.5 | 13.3 | 6.5 | Δ~X | X | X | 31.3 | X | ○~Δ |
| Ex | D-29 | H-9 | 50 | L-2 | 50 | 181.6 | 25.4 | 0.61 | 297.7 | 41.6 | ◎ | ○ | ○ | 3.1 | ○ | ○ |

Note:
(1) Ex . . . Example
(2) C.Ex . . . Comparative Example
(3) GPC unmeasured

EXAMPLE 2

A flask was replaced with nitrogen and charged with 72 parts of styrene and 28 parts of butyl acrylate as vinyl monomers. The mixture was heated to 120° C. and polymerized in bulk for 10 hours at the temperature. The conversion obtained was 55%. in the next step, 30 parts of xylene was added and the resulting solution was continuously added over 8 hours with a solution obtained by dissolving 0.1 part of dibutyl peroxide in 50 parts of xylene while maintaining the reaction temperature at 130° C. The polymerization was completed after continuing the reaction for further an hour. The resulting high molecular weight polymer was named A-1.

In the next step, solution polymerization was conducted by continuously adding a homogeneous solution of 0.5 mole of di-t-butyl peroxide in 100 moles of styrene at a rate of 750 ml/hr to the mixture consisting of 70 parts of styrene and 30 parts of a solvent mixture containing xylene and ethylbenzene. The reaction conditions maintained were an internal reactor temperature of 210° C. the internal pressure of 6 $Kg/cm^2$ and an outlet temperature of 100° C.

The resulting low molecular weight styrene polymer had a conversion of 99.5% by weight. The molecular weight was measured in accordance with gel permeation chromatography by using monodispersed standard polystyrene as a reference sample and tetrahydrofuran as an eluent. The number average molecular weight thus obtained was 2,100.

Besides the solid polymer A-2 was obtained by removing the solvent and its Tg was measured with a differential scanning calorimeter by using alumina as reference. The measured Tg was 70° C.

A mixture was prepared from 50 parts of the above low molecular weight styrene polymer A-2 and 90 parts of the aforesaid high molecular weight polymer A-1 (50 parts as solid). The solvent was removed from the mixture by heating to 200° C. and flashing into a vacuum system of 10 mmHg. The resulting polymer had Mn of 2,800, Mz of 652,000, Mz/Mn of 233 and Tg of 57° C.

EXAMPLES 3–4

A mixture of low molecular weight and high molecular weight polymers were prepared by conducting the same procedures as in Example 2 except the low molecular weight styrene polymer was polymerized at 190° C. and 230° C. The molecular weights and Tg of the resultant polymer mixture are illustrated in Table-3.

COMPARATIVE EXAMPLES 1–2

A mixture of low molecular weight and high molecular weight polymers were prepared by conducting the same procedures as in Example 2 except the low molecular weight styrene polymer was polymerized at 170° C. and 240° C. The molecular weights and Tg of the resultant polymer mixture are illustrated in Table 3.

EXAMPLE 5

A flask was charged with 100 parts of xylene and refluxed at about 140° C. A mixture of 90 parts of styrene, 10 parts of butyl acrylate and 8 parts of AIBN was continuously added dropwise over 10 hours. The polymerization was continued for further 2 hours to obtain low molecular weight polymer. Then the solvent was removed to obtain the solid low molecular weight polymer B-2.

A mixture of low molecular weight and high molecular weight polymers were prepared by conducting the same procedures as in Example 2 except the above obtained low molecular weight polymer B-2 was used in place of the low molecular weight polymer A-2. The molecular weights and Tg of the resulting polymer mixture are illustrated in Table-3.

COMPARATIVE EXAMPLE 3

A mixture of low molecular weight and high molecular weight polymers were prepared by conducting the same procedures as in Example 2 except 80 parts of the low molecular weight styrene polymer A-2 and 36 parts of the high molecular weight polymer solution A-1 (20 parts as solid) were mixed. The molecular weights and Tg of the resulting polymer mixture are illustrated in Table-3.

EXAMPLE 6

In the preparation of high molecular weight polymer in Example 2, a high molecular weight polymer B-1 was obtained by conducting the same procedures as in Example 2 except 30 parts of xylene were added after completing the bulk polymerization and 0.3 part of tetraethylene glycol dimethacrylate was specially added as a crosslinking agent to the solution which had been obtained by dissolving 0.1 part of di-t-butyl peroxide in 50 parts of xylene. Thereafter the procedures in Example 2 were repeated to obtain a mixture of low molecular weight and high molecular weight polymers. The molecular weights and Tg are illustrated in Table-3.

TABLE 3

| No. | (2) C.Ex −1 | (1) Ex −2 | Ex −3 | Ex −4 | C.Ex −2 | C.Ex −3 | Ex −5 | Ex −6 |
|---|---|---|---|---|---|---|---|---|
| Low molecular weight polymer (L) | | | | | | | | |
| Styrene | 100 | ← | ← | ← | ← | ← | 90 | 100 |
| Butyl acrylate | 0 | ← | ← | ← | ← | ← | 10 | 0 |
| Polymerization (°C.) | 170 | 210 | 190 | 230 | 240 | 210 | 140 | 210 |
| Mn | 7200 | 2100 | 3800 | 1100 | 920 | 2100 | 2300 | 2100 |
| Tg (°C.) | 87 | 57 | 70 | 45 | 38 | 57 | 47 | 57 |
| High molecular weight polymer (H) | A-1 | ← | ← | ← | ← | ← | ← | B-1 |
| Polymer mixture | | | | | | | | |
| H/L (as solid) | 50/50 | ← | ← | ← | ← | 20/80 | 50/50 | ← |
| Mn | 9700 | 2800 | 4700 | 2000 | 1600 | 2500 | 3700 | 2900 |
| Mz (× 1000) | 675 | 652 | 663 | 634 | 608 | 154 | 658 | 1210 |
| Mz/Mn | 70 | 233 | 141 | 317 | 380 | 62 | 178 | 417 |
| Tg (°C.) | 71 | 57 | 62 | 50 | 46 | 57 | 51 | 58 |
| Duplication characteristics | | | | | | | | |
| Fixing ability | Δ | ◎ | ○ | ◎ | ◎ | ○ | ◎ | ◎ |
| Contamination of white background | ○ | ○ | ○ | ○ | ○ | Δ | ○ | ○ |
| Offset resistance | ○ | ○ | ○ | ○ | ○ | X | ○ | ○ |
| Blocking resistance | ◎ | ◎ | ◎ | ○~Δ | X | ○ | ○~Δ | ◎ |
| Variation of electrostatic charge | 4.8 | 5.2 | 5.2 | 5.7 | 7.5 | 12.1 | 5.2 | 5.1 |

TABLE 3-continued

| No. | (2) C.Ex −1 | (1) Ex −2 | Ex −3 | Ex −4 | C.Ex −2 | C.Ex −3 | Ex −5 | Ex −6 |
|---|---|---|---|---|---|---|---|---|
| Dispersibility of coloring agent | ○ | ○ | ○ | ○ | Δ | X | ○ | ○ |

Note:
(1) Ex . . . Example
(2) C.Ex . . . Comparative Example

What is claimed is:

1. A method for the preparation of a toner resin having a number average molecular weight (Mn) of 2,000–15,000, a Z average molecular weight (Mz) of not less than 400,000, and Mz/Mn of 50–600, which comprises steps a) to d):

a) conducting bulk polymerization of vinyl monomer at 60°–150° C. to a conversion of 30–90% by weight, successively adding a solvent to reduce the viscosity of the reaction mixture and carrying out a solution polymerization at 60°–150° C., so as to obtain a high molecular weight polymer solution;

b) polymerizing a styrene type vinyl monomer at 190°–230° C. in a state of solution so as to obtain a low molecular weight polymer solution;

c) mixing 30–70 parts by weight of a solid component of said high molecular weight polymer solution with 70–30 parts by weight of a solid component of said low molecular weight polymer solution;

d) removing the solvent from the resulting mixture.

2. The method as claimed in claim 1 wherein a mixed solution of low molecular weight and high molecular weight polymers is obtained upon removal of solvent by vacuum flashing.

3. The method as claimed in claim 1, wherein, at the conclusion of bulk polymerization or during the solution polymerization stage, from 0.01–1 part by weight of divinyl compound is added to the polymerization medium per 100 parts by weight of total monomer.

4. The method as claimed in claim 1, wherein solution polymerization is conducted in the presence of from 0.01–10 parts by weight of a polymerization initiator per 100 parts by weight of monomer employed.

5. The method as claimed in claim 1, wherein the vinyl monomer undergoing bulk polymerization contains from 1–15 parts by weight of methacrylic acid per 100 parts by weight of the vinyl monomer undergoing bulk polymerization.

* * * * *

UNITED STATES PATENT AND TRADEMARK OFFICE

CERTIFICATE OF CORRECTION

PATENT NO. : 5,362,595

DATED : November 8, 1994

INVENTOR(S) : Nobuhiro Hirayama, et al.

It is certified that error appears in the above-indentified patent and that said Letters Patent is hereby corrected as shown below:

On the title page, Item [60], the Related U.S. Application Data should read:

--Continuation of Ser. No. 747,700, Aug. 20, 1991, abandoned, which is a division of Ser. No. 320,239, Feb. 24, 1989, Pat. No. 5,084,368, filed as PCT/JP87/00719, Sep. 30, 1987.--

Signed and Sealed this

Eleventh Day of April, 1995

Bruce Lehman

*Attest:*

BRUCE LEHMAN

*Attesting Officer*

*Commissioner of Patents and Trademarks*